United States Patent [19]

Neidich

[11] Patent Number: 4,865,567

[45] Date of Patent: Sep. 12, 1989

[54] MINIATURE BARREL FEMALE TERMINAL

[75] Inventor: Douglas A. Neidich, Harrisburg, Pa.

[73] Assignee: InterCon Systems, Inc., Harrisburg, Pa.

[21] Appl. No.: 256,033

[22] Filed: Oct. 11, 1988

[51] Int. Cl.[4] ..... H01R 11/22

[52] U.S. Cl. ..... 439/851; 439/842

[58] Field of Search ..... 439/885, 816, 821, 842–845, 439/849, 850–857

[56] References Cited

U.S. PATENT DOCUMENTS

| | | | |
|---|---|---|---|
| 2,579,739 | 12/1951 | Hayes | 173/259 |
| 3,155,450 | 11/1964 | Filson | 338/258 |
| 3,439,316 | 4/1969 | Evans | 439/853 |
| 3,622,956 | 11/1971 | Zak | 439/850 |
| 4,031,614 | 6/1977 | Gipe | 29/630 |
| 4,133,599 | 1/1979 | Powell | 339/258 |
| 4,445,747 | 5/1984 | Neidich | 339/256 |

FOREIGN PATENT DOCUMENTS

| | | | |
|---|---|---|---|
| 1197950 | 8/1965 | Fed. Rep. of Germany | 439/849 |
| 2524346 | 12/1976 | Fed. Rep. of Germany . | |
| 2615820 | 10/1977 | Fed. Rep. of Germany . | |
| 2631820 | 1/1978 | Fed. Rep. of Germany | 439/849 |
| 1540606 | 9/1968 | France | 439/849 |

*Primary Examiner*—David Pirlot

*Attorney, Agent, or Firm*—Thomas Hooker

[57] ABSTRACT

A miniature barrel female terminal and a terminal preform are disclosed comprising two c-shaped tapered width beams at each end of the terminal, the beams at one end of the terminal joined to a respective beam at the opposite end by integral contact strips and a maximum width spine. The formed terminal defines three pressure line contact points at the spine and the contact strips, respectively.

29 Claims, 1 Drawing Sheet

MINIATURE BARREL FEMALE TERMINAL

FIELD OF THE INVENTION

The invention relates to a miniature barrel female terminal rolled from thin uniform thickness metal stock for forming an electrical connection with a pin inserted into the terminal and to a flat stamped preform used in the manufacture of the terminal.

DESCRIPTION OF THE PRIOR ART

The reduction in size of electronic components, such as computer chips and the like, and the resultant reduction in the size of electronic assemblies have forced circuit designers to reduce the size of the terminals and connector blocks used to form electrical interconnections between assemblies. This trend is particularly evident in modern computers where previous connector blocks used for forming connections between assemblies spaced terminals and pins apart by a 0.100 inch so that it was possible to locate approximately 100 terminals in a one square inch area on the face of a block. The pins were commonly 0.025 inch round or square.

Present requirements require that approximately 450 terminals be provided in the same one inch area for mating with pins having a diameter of approximately 0.015 inch. The miniature barrel female terminals used to meet this requirement are extremely small. These terminals are stamp-formed from a thin sheet of suitable metal foil stock.

The manufacture of terminals from a metal foil is difficult. The small size of the terminal requires the punch parts be very small. Especially small punches are required to blank out very small interior openings from the terminal preform. Small punches are hard to make and tend to chip and break during production.

Another major problem in the manufacturing of terminals of very small size is that the manufacturing tolerances inherent in a typical stamping operation remain unchanged despite the miniature size of the terminal. These relatively large tolerances mean that the size of an individual miniature terminal manufactured within specifications can vary as much as 13 percent in a given dimension. The terminal must have highly compliant springs to assure that high pressure electrical connections are formed between the terminal and the inserted pin, despite the tolerance-induced variations in the size of the terminal.

A prior art miniature barrel female terminal includes a spine connected to opposed bridges by a number of uniform width angled ribs with narrow slots separating adjacent ribs. The entire barrel clasps the inserted pin. This terminal is relatively difficult to manufacture because the narrow slots between the ribs require the use of closely spaced and extremely small punches. The lead-in end of the terminal is slanted and does not provide an optimum target for pin insertion.

SUMMARY OF THE INVENTION

The disclosed miniature barrel terminal is reliably stamped from metal foil and includes a spine and two opposed contact strips joined to the spine by tapered C-shaped beams. The beams have minimum width ends joining the strips and increase in width to joined maximum width ends at the spine. A single relatively large and easy-to-punch opening is formed through the terminal between each strip and spine. The compliant tapered C-shaped beams provide high pressure electrical line connections between the strips and the spine and an inserted pin despite large manufacturing tolerances. The beams are spaced laterally from the pin to improve compliance and prevent binding. The relatively large punches used to form the two openings between the strips and the spine are strong and have a long production life, thereby avoiding breakdowns experienced in the manufacture of miniature terminals with narrow openings.

Other objects and features of the invention will become apparent as the description proceeds, especially when taken in conjunction with the accompanying drawings illustrating the invention, of which there is one sheet and one embodiment.

IN THE DRAWINGS

Figure 1:
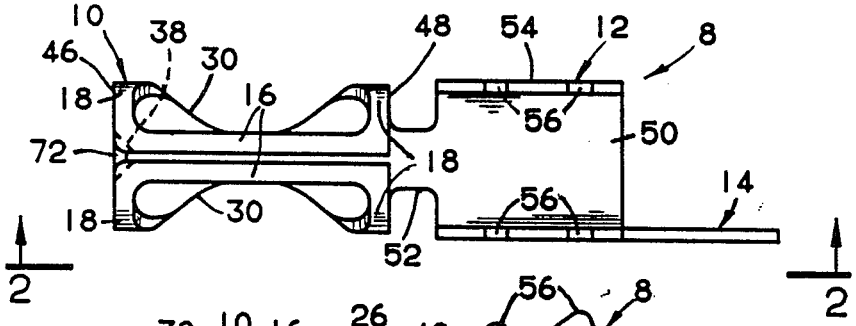
FIG. 1 is a top view of a miniature female barrel female terminal assembly.

Terminal assembly 8 includes miniature barrel female terminal 10, terminal mounting channel 12 and solder lug 14 integrally stamp-formed from thin uniform thickness metal stock. The terminal 10 has a pair of spaced parallel contact strips 16 located on opposite sides of the terminal and extending axially along the length of the terminal. Two C-shaped tapered width beams 18 at each end of the terminal have minimum width ends 20 joined to the ends of the strips and maximum width ends 22 joined to each other. These maximum width ends extend axially along the terminal and are joined at the center of the terminal to the maximum width ends of the like beams at the other end of the terminal. The four joined maximum width beam ends form a terminal spine 24 extending axially parallel to the contact strips.

Figure 4:
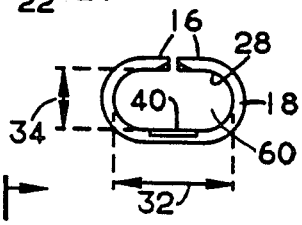
FIG. 4 is a front view of the terminal assembly.
Figure 6:
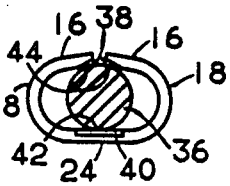
FIG. 6 is a partial sectional view taken along line 6—6 of FIG. 5.
Figure 5:
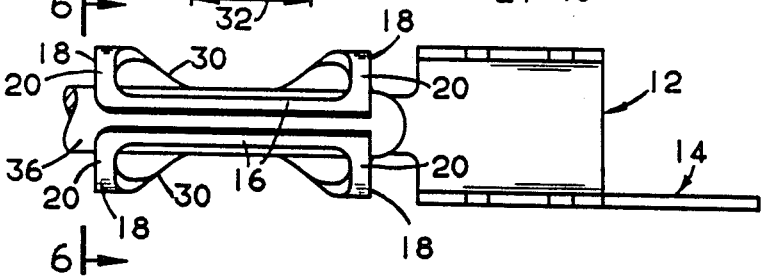
FIG. 5 is a top view like FIG. 1 but showing the terminal and an engaged contact pin.

As shown in FIG. 4, the contact strips and beams define a barrel-shaped body 26 with the spaced strips on one side of the body and the spine on the other side of the body across from the strips. The interior width 32 of the body is greater than the interior height 34 of the body to increase the length of the tapered C-shaped beams for added resiliency and to assure contact between the terminal and a cylindrical male pin 36 inserted into the terminal occurs only at three high pressure contact lines. One contact line 42 extends along the spine. Contact lines 44 extend along the strips 16. The beams 18 between the strips and spine are laterally spaced from the pin to permit the relatively long beams to flex freely and to reduce friction between the beams and the pin.

The ends of the contact strips 16 and spine 24 at the insertion end 46 of the terminal are provided with chamfers or flared portions 38 and 40 to eliminate burrs and edge roughness formed during stamping of the terminal and to aid in smooth guiding of the pin 36 into the socket interior 28 of the terminal. The diameter of the pin 36 is slightly greater than the spacing between the spine 24 and contact strips 16 so that upon insertion of the pin the strips are forced away from the spine and beams 18 are stressed to provide redundant high pressure electrical connections between the pin and the terminal at lines 42 and 44. The lines extend the length of the terminal. As shown in FIG. 4, prior to insertion of the pin the strips 16 are located above the spine with the lower surfaces of the strips essentially parallel to the upper surface of the spine. Insertion of the pin into the terminal flexes the strips upwardly and outwardly a slight distance so that the contact lines 44 between the pin and the strips are located to either side of the top of the pin and confine the pin in the center of the terminal with the bottom of the pin held tightly against the spine at contact line 42.

Beams 18 are formed from the uniform thickness stock from which the terminal 10 is manufactured and have a tapered shape with the minimum thickness end joined to a contact strip and the maximum thickness end joined to the similar end of the adjacent beam. Insertion of a pin into a terminal increases the separation between the strip and the spine and stresses the U-shaped beams. The tapered shape of the beams assures that the stress in the beams is evenly distributed and continues along the length of the beams. Evenly distributed stress assures that the beams are uniformly deflected along their lengths. Overstressing and stress concentration are avoided. Uniform distribution of stress assures that the beams retain their desired spring properties despite flexing from repeated insertions and withdrawals of the contact pin.

The smooth distribution of stress along the length of the beams makes the beams highly compliant permitting deflection over relatively wide ranges without deforming the beams. This is especially important in very small terminals like terminals 10 which mate with very small contact pins. For instance, terminal 10 may mate with a contact pin 36 having a diameter of 0.015 inch. The terminal 10 is stamped with a thin foil sheet of beryllium copper having a thickness of about 0.0025 inch. Normal dimensional stamping errors or tolerances for the manufacture of the terminal from the foil are in the range of ±0.0015 inch to 0.0020 inch, or as much as 13 percent of the diameter of the pin. Because of the very small size of the terminal, the tolerances can result in terminals which are properly manufactured but in which the distance between the spine and the contact strips may vary, from terminal to terminal, as much as 13 percent. The high compliance of the tapered beams 18 compensates for dimensional variations due to stamping tolerances and forms pressure contacts without overstressing the beams. The compliant beams also compensate for variations in pin diameter.

During insertion of the pin into the lead end 4 of the terminal the adjacent beams 18 engage the tip of the pin and are biased in the direction of insertion. The contact strips 16 and beams 18 at the remote end 48 of the terminal support the beams at the lead end against axial shifting with the pin to maintain geometrical integrity of the terminal.

Figure 2:
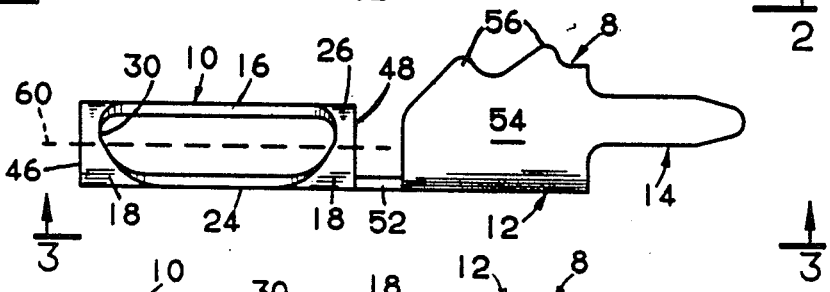
FIG. 2 is a side view of the terminal assembly of FIG. 1 taken along line 2—2.
Figure 3:
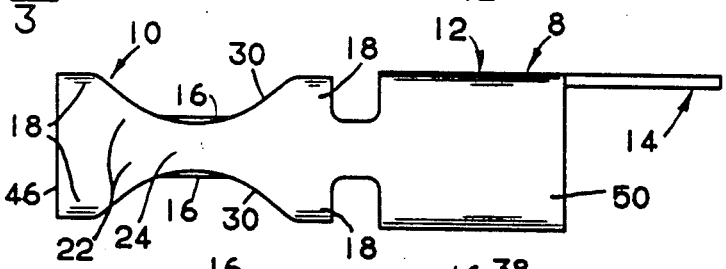
FIG. 3 is a bottom view taken along line 3—3 of FIG. 2.

The mounting channel 12 includes a flat base 50 connected to the terminal spine 24 by interconnecting member 52. A pair of walls 54 extend perpendicularly upward from the base 50. Friction crests 56 are provided on the tops of the walls 54. Solder lug 14 extends rearwardly from one wall 54 as shown in FIGS. 1 and 2.

The terminal assembly 8, comprising the terminal, interconnecting member, channel and lug, is preferably mounted in a connector block with terminal 10 confined within a cavity having a mouth communicating with the interior opening 28 through lead end 46, channel 12 frictionally secured in a cavity in the block behind the terminal and lug 14 extending outwardly of the block for solder or other connection to a circuit line. A terminal 10 formed from beryllium copper foil having a thickness of 0.0025 inch has a total width of about 0.032 inch and a total height of about 0.0175 inch. These small terminals can be fitted in individual cavities within an insulating connector block in a very dense grid in which the central axis 60 of adjacent terminals are spaced apart by as little as 0.040 inch in the direction of the height of the terminal and 0.050 inch in the direction of the width of the terminal. When arranged in cavities on the grid with this spacing approximately 450 terminal assemblies are provided in a one square inch area. This high density configuration is required for modern rapid computer and electronic applications, particularly for high speed super computers where minimum space is available and reduced length electrical paths are desired. The three line pressure contacts between each pin and terminal are also highly desirable in high speed computer applications.

Figure 7:
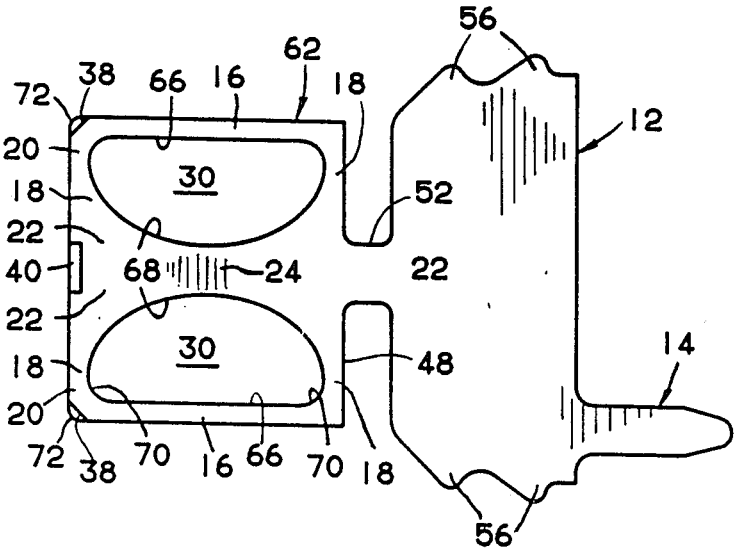
FIG. 7 illustrates a stamped preform used in the manufacture of the disclosed terminal assembly.

FIG. 7 illustrates a stamped rectangular preform 62 which is rolled to form terminal 10. In describing the preform portion 64, the reference numbers referred to in the description of the rolled miniature barrel terminal 10 will be used to describe features of the preform which will form the terminal features, after rolling.

A pair of D-shaped openings 30 ar stamped through opposite sides of the preform to define contact strips 16 and the four tapered beams 18. The openings 30 are defined by the inner edges 66 of strips 16 and the concave inner edges 68 of the beams joining each strip. Edges 68 are arcuate may be circular arcs. The height of the openings, the distance 66 from the center of the spine to the center of the opposite edge, is about one half the length of the strip 16.

The corner sections 70 between edges 66 and 68 are smoothly rounded to facilitate stamping of the foil and to eliminate stress concentration. The corners 72 of the preform at the lead end 46 are rounded and carry chamfers 38 which cooperate with chamfer 40 at the center of the end for smooth insertion of the pin into the terminal.

When the preform is rolled to form terminal assembly 8 terminal 10 has an axial length of 0.062 inch and height and width as described. The result is a very miniature terminal assembly having a total axial length of about 0.148 inch. Stated differently, sixteen terminals 10 can be arranged end to end to within the distance of one inch.

It is very difficult to stamp manufacture miniature terminals of this size reliably in a long, continuous production run. The relatively large size of openings 30 facilitates the manufacture of terminal 10. Only two relatively large punches are required to blank out the openings 30. These openings are nearly as long as the length of the terminal preform and nearly one half the width of the terminal preform. They are formed by relatively large strong punches which withstand manufacturing stresses well and are suited to long term manufacture runs. Smaller punches required to form relatively smaller openings in other types of miniature terminals readily chip and break thereby manufacturing defective terminals and risking injury to other die components.

While I have illustrated and described a preferred embodiment of my invention, it is understood that this is capable of modification, and I therefore do not wish to be limited to the precise details set forth, but desire to avail myself of such changes and alterations a fall within the purview of the following claims.

What I claim as my invention is:

1. A miniature barrel female terminal comprising a pair of closely spaced contact strips extending along the length of the terminal; two C-shaped tapered beams at each end of the terminal, each beam having a minimum width end joining a strip and a maximum width end joining the maximum width end of the other beam at the end of the terminal, said beams increasing in width from the minimum width end toward the maximum width end, the joined maximum width ends extending toward the other end of the terminal and joining the maximum width ends of the beams at the other end of the terminal to form a spine extending along the length of the terminal and spaced from the contact strips; and a pair of openings formed through the terminal to either side of the spine, each opening being defined by the inner edge of one contact strip and the inner edges of the beams joining the contact strip; said beams locating the contact strips above the spine for reception of a pin contact therebetween.

2. A terminal as in claim 1 wherein the inner edges of the contact strips are straight and the inner edges of the beams joining each contact strip are arcuate.

3. A terminal as in claim 1 wherein the strips and spine extend generally parallel along the length of the terminal.

4. A terminal as in claim 3 wherein the outer edges of beams lie in planes perpendicular to the strips and spine.

5. A terminal as in claim 3 including lead-in chamfers at the ends of the strips and spine at one end of the terminal and means integrally joining the spine at the other end of the terminal for forming an electrical connection with a circuit element.

6. A terminal as in claim 3 wherein the distance between the spine and the strips is less than the distance between the centers of the beams on opposite sides of the terminal whereby a circular pin inserted into the terminal between the spine and strips forces the spine and strips apart to form three pressure line contacts therebetween.

7. A terminal as in claim 3 wherein said beams are smoothly curved between the maximum and minimum width ends thereof.

8. A terminal as in claim 3 formed from a metal foil.

9. A terminal as in claim 3 wherein the inner edges of the beams joining each contact strip are arcuate.

10. A terminal as in claim 9 wherein said openings are generally D-shaped.

11. A terminal as in claim 9 formed from a flat preform wherein such inner edges on the preform lie on circle.

12. A terminal as in claim 11 wherein the height of each opening equals the radius of the circle.

13. A terminal as in claim 9 wherein each opening has rounded corners at the ends of the adjacent contact strip.

14. A terminal as in claim 13 wherein the inner edge of each strip is straight.

15. A terminal as in claim 13 wherein the maximum width ends of the beams at each end of the terminal are joined at the center of the spine.

16. A terminal as in claim 3 wherein the inner edge of each contact strip is straight and the inner edges of the beams joining the contact strip are concave.

17. A terminal as in claim 16 wherein such inner edges are arcuate.

18. A terminal as in claim 3 wherein said terminal is formed from uniform thickness strip stock and the inner surfaces of the strips lie on a first plane and the inner surface of the spine lies in a second plane parallel to the first plane.

19. A terminal as in claim 18 wherein the distance between said planes is less than the maximum interior distance between adjacent beams at either end of the terminal.

20. A miniature barrel female terminal formed from a stamped and rolled foil preform, the terminal comprising of a pair of closely spaced and parallel contact strips extending along the length of the terminal; two C-shaped tapered beams at each end of the terminal, each beam having a minimum width end joining a strip and a maximum width end joining the maximum width end of the other beam at the end of the terminal, said beams smoothly increasing in width from the minimum width end toward the maximum width end, the joined maximum width ends extending toward the other end of the terminal and joining the maximum width ends of the beams at the other end of the terminal to form a spine extending along the length of the terminal parallel to and spaced from the contact strips; and a pair of generally D-shaped openings formed through the terminal to either side of the spine, each opening being defined by a straight inner edge of one contact strip and arcuate inner edges of the beams joining the contact strip said beams locating the contact strips above the spine for reception of a pin contact therebetween, the distance between the spine and the strips being greater than the distance between the centers of the beams on opposite sides of the terminal whereby a circular pin inserted into the terminal between the spine and strips forces the strips apart to form three pressure line contacts therebetween.

21. A terminal as in claim 20 wherein the maximum width ends are joined at the center of the spine.

22. A terminal as in claim 20 wherein the outer edges of the beams lie in planes perpendicular to the strips and spine.

23. A terminal as in claim 22 wherein said beams are smoothly curved between the maximum and minimum width ends.

24. A terminal as in claim 20 including lead-in chamfers at the ends of strips and spine at one end of the terminal and means integrally joining the spine at the other end of the terminal for forming an electrical connection with a circuit element.

25. A uniform thickness stamped metal preform adapted to be rolled to form a miniature barrel female terminal, the preform including a rectangular body, contact strips extending along opposed sides of the body and two tapered width beams at each end of the body, each beam having a minimum width end joining a strip and a maximum width end joining the maximum width end of the other beam at the end of the terminal, said beams smoothly increasing in width from the minimum width end toward the maximum width end, the joined maximum width ends extending toward the other end of the terminal and joining the maximum width ends of the beams at the other end of the terminal to form a spine extending along the length of the terminal generally parallel to and spaced from the contact strips; and a pair of openings formed through the terminal to either side of the spine, each opening being defined by the inner edge of one contact strip and the outer edges of the beams joining the contact strip.

26. A preform as in claim 25 including chamfers formed in the strips and spine at one end of the preform.

27. A preform as in claim 25 formed from metal foil stock.

28. A preform as in claim 25 wherein said ends extend perpendicular to said strips and spine.

29. A preform as in claim 28 wherein the inner edges of said beams are arcuate.

* * * * *

UNITED STATES PATENT OFFICE

CERTIFICATE OF CORRECTION

PATENT NO. : 4,865,567

DATED : September 12, 1989

INVENTOR(S) : Douglas A. Neidich

It is certified that error appears in the above-identified patent and that said Letters Patent is hereby corrected as shown below:

Column 3, line 53, change "4" to --46--.

Column 4, line 30, change "ar" to --are--; and line 35, after "arcuate" insert --and--.

Claim 11, line 2, after "on" insert --a--.

Signed and Sealed this

Fourth Day of September, 1990

*Attest:*

*Attesting Officer*

HARRY F. MANBECK, JR.

*Commissioner of Patents and Trademarks*